US005588186A

United States Patent [19]

Ko

[11] Patent Number: 5,588,186

[45] Date of Patent: Dec. 31, 1996

[54] BELT WITH RATCHET TYPE BUCKLING MEANS

[76] Inventor: Soon-Myung Ko, 122-1703 Olympic APT, Bangee-Dong, Songpa-gu, Seoul 138-150, Rep. of Korea

[21] Appl. No.: 451,179

[22] Filed: May 26, 1995

[51] Int. Cl.[6] ..... A44B 11/00

[52] U.S. Cl. ..... 24/585; 24/170

[58] Field of Search ..... 24/170, 171, 585, 24/683

[56] References Cited

U.S. PATENT DOCUMENTS

| | | | |
|---|---|---|---|
| 1,483,853 | 2/1924 | Schwerd | 24/585 |
| 3,900,923 | 8/1975 | Thomas . | |
| 4,669,155 | 6/1987 | Chen . | |
| 4,727,630 | 3/1988 | Alan . | |
| 4,958,414 | 9/1990 | Benoit . | |

FOREIGN PATENT DOCUMENTS

| | | | |
|---|---|---|---|
| 0769195 | 2/1957 | United Kingdom | 24/170 |
| 2264978A | 9/1993 | United Kingdom . | |

*Primary Examiner*—Victor N. Sakran

*Attorney, Agent, or Firm*—Vidas, Arrett & Steinkraus, P.A.

[57] ABSTRACT

A belt with improved ratchet type buckling means is disclosed. The belt has a pawl assembly vertically held between the top and bottom walls of the buckle and selectively engaging with a ratchet part. The pawl assembly has a rotatable cylinder, a pawl coupled to the cylinder and adapted for selectively engaging with the ratchet part. A vertically movable push rod is received in the cylinder such that the bottom of the push rod projects out of the bottom wall of the bucket. The cylinder along with the pawl is rotated to make the pawl disengage from the ratchet part when the push rod vertically moves up in the cylinder. In order to rotate the cylinder with the pawl, a radial projection of the push rod is received in an inclined slit formed on a side wall of the cylinder.

3 Claims, 3 Drawing Sheets

BELT WITH RATCHET TYPE BUCKLING MEANS

BACKGROUND OF THE INVENTION

1. Field of the Invention

The present invention relates in general to belts with ratchet type buckling means and, more particularly, to a structural improvement in the buckling means for simplifying the construction of the belt and easily fastening or unfastening the belt.

2. Description of the Prior Art

Belts are adjustable bands or strips of leather, synthetic resin, etc worn around the waist to support or keep in place clothes. A typical belt worn around the waist to keep in place clothes, in particular, shirt and trousers and to provide decoration effect has a plurality of holes formed in an end portion thereof and a buckle coupled to the other end portion thereof. The buckle has a bolt which will be inserted in one of the holes of the one end portion to fasten the belt.

In the prior art, a belt with a ratchet type buckling means has been proposed. In the belt with the ratchet type buckling means, a ratchet part of a given length is provided in an end portion of the belt, while a pawl for selectively engaging with the ratchet part is provided in a buckle of the other end portion of the belt. In order to facilitate operation of the pawl, a lever is integrally formed with the pawl. The lever is turned to engage or disengage the pawl with or from the ratchet part and thereby fastening or unfastening the belt worn around the waist.

As the pawl lever is integrally formed with the pawl, the above belt has a problem that the size of the buckle is enlarged and thereby increasing weight of the belt and causing inconvenience in use of the belt. Another problem of the above belt is resided in that a user should repeatedly lever, putting up with troublesome, the pawl every when unfastening the belt.

Korean Utility Model Appln. No. 92-5785 discloses a belt with a ratchet type buckling means. As shown in FIGS. 4*a* and 4*b*, an end portion of the belt 20 has a ratchet part 21, while the other end portion of the belt 20 is coupled to a buckle 22. The buckle 22 has top and bottom walls 22*a* and 22*b* which horizontally integrally extend from the top and bottom edges of a front panel and are integrated into a single body by means of a narrow back panel 22*c*. A spring-biased pawl 24 which will engage or disengage with or from the ratchet part 21 is pivoted to the back panel 22*c*. The pawl 24 is bent round at its center and biased by a spring 23. A movable shaft 26*a* vertically penetrates the top and bottom walls 22*a* and 22*b* in back of the front panel. Top and bottom ends of the movable shaft 26*a* projecting out of the walls 22*a* and 22*b* are provided with their push buttons 27 and 27*a*. A cylindrical bolt 25, comprising top and bottom pieces, is fixedly fitted over the shaft 26*a* such that the top and bottom pieces are spaced out at an interval. The bolt 25 is biased by a compression coil spring or a bumper spring 26 downward, the bumper spring 26 being fitted over the shaft 26*a* above the bolt 25. The bottom piece of the bolt 25 has a conical top. The round bent center of the spring-biased pawl 24 is rested on the shaft 26*a* between the top and bottom pieces of the bolt 25.

When fastening the belt, the button 27*a* is manually pushed up to lift up the shaft 26*a* along with the bolt 25. The conical top of the bottom piece of the bolt 25 thus lifts up the round bent center of the pawl 24 and thereby disengaging the pawl 24 from the ratchet part 21. When removing the pushing force from the button 27*a*, the shaft 26*a* along with the bolt 25 elastically moves down by the spring 26 so that the pawl 24 elastically returns to its original position by the spring 23 and is brought into engagement with the ratchet part 21. However, this belt has a problem that the buckle 22 should be sufficiently thickened such that the turning motion of the pawl 24 should be totally covered by the thickness of the buckle 22. This makes the buckle 22 dull and stout. Another problem of the belt is resided in that the turning motion of the pawl 24 caused by the vertical movement of the shaft 26*a* can not be smoothly achieved.

SUMMARY OF THE INVENTION

It is, therefore, an object of the present invention to provide a belt with ratchet type buckling means in which the above problems can be overcome and which has a simple construction and merely needs small force when unfastening the belt.

In order to accomplish the above object, the invention provides a belt with ratchet type buckling means comprising a buckle coupled to an end portion of the belt and having a screw hole and a rectangular hole, a ratchet part provided on the back surface of the other end portion of the belt, and a pawl assembly vertically held between the top and bottom walls of the buckle and selectively engaging with the ratchet part. The pawl assembly includes a rotatable cylinder vertically placed between the screw hole and the rectangular hole and rotatably coupled to the screw hole, a pawl coupled to said cylinder and adapted for selectively engaging with said ratchet part, a vertically movable push rod received in said cylinder such that the bottom of the push rod projects out of the rectangular hole, and means for selectively rotating said cylinder along with the pawl to make the pawl disengage from the ratchet part when said push rod vertically moves up in the cylinder. The cylinder rotating means includes a radial projection mounted on a side wall of said push rod, and an inclined slit formed on a side wall of said cylinder and movably receiving said radial projection.

The pawl has a stopper which is stopped by a stopper of the cylinder and thereby preventing the pawl from sudden turning motion relative to the cylinder.

Fastening of the belt is simply achieved by passing the other end portion of the belt through the buckle until the spring-biased pawl engages with one of the teeth of the ratchet part. To unfasten the belt, the push rod is lifted up while compressing the spring. In this case, the rod does not rotate but is lifted up in the cylinder so that the pawl is turned and thereby disengaging from the ratchet part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
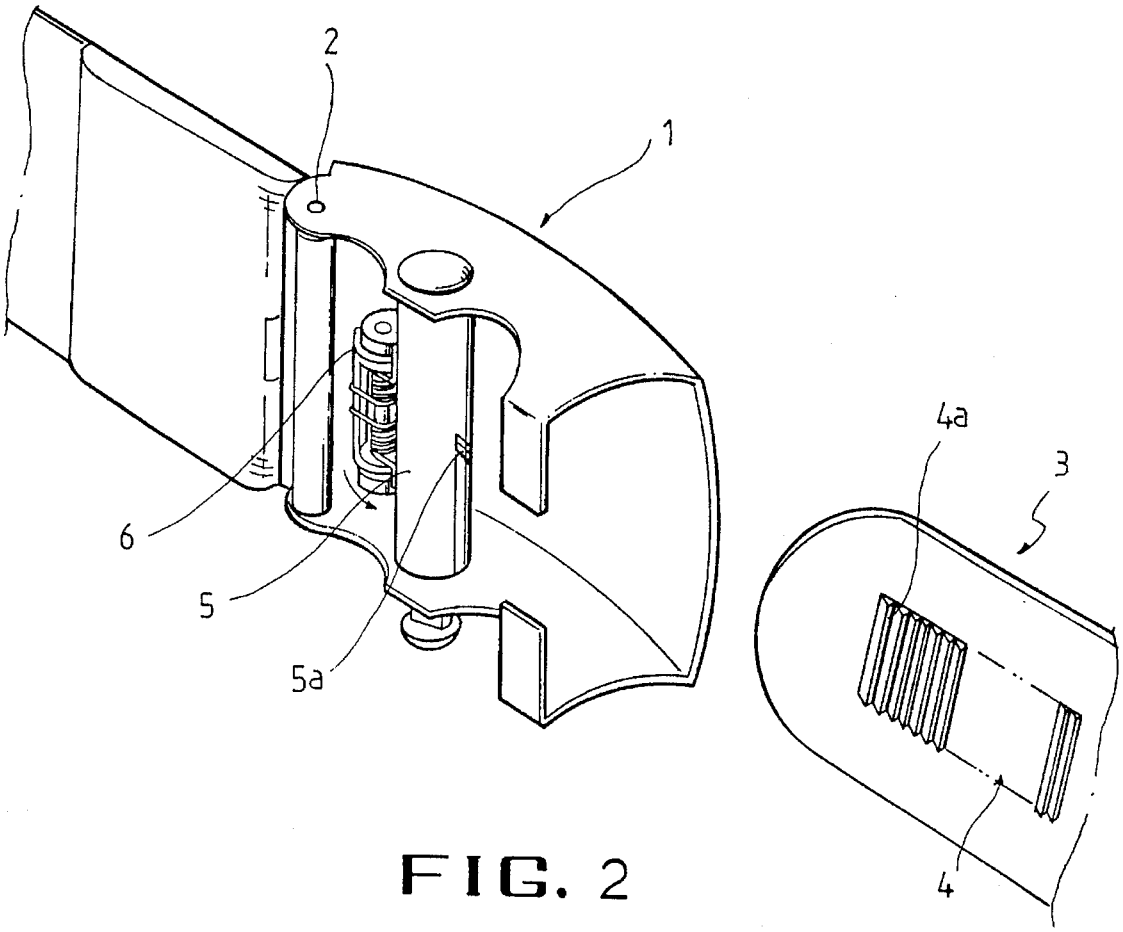
FIG. 1 is a perspective view of a belt of the invention, showing a construction of ratchet type buckling means.
Figure 2:
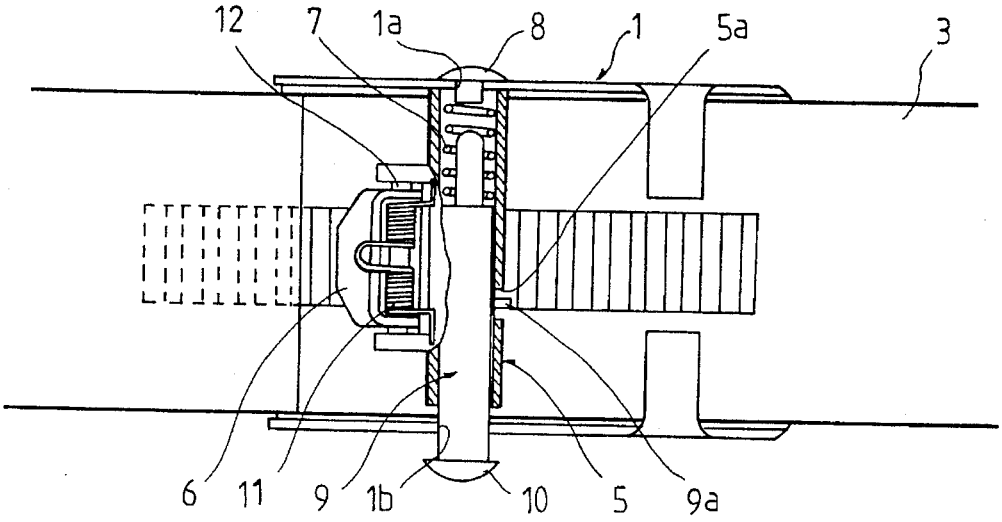
FIG. 2 is a partially sectioned view of the belt of FIG. 1, showing the buckling means after fastening the belt.
Figure 3:
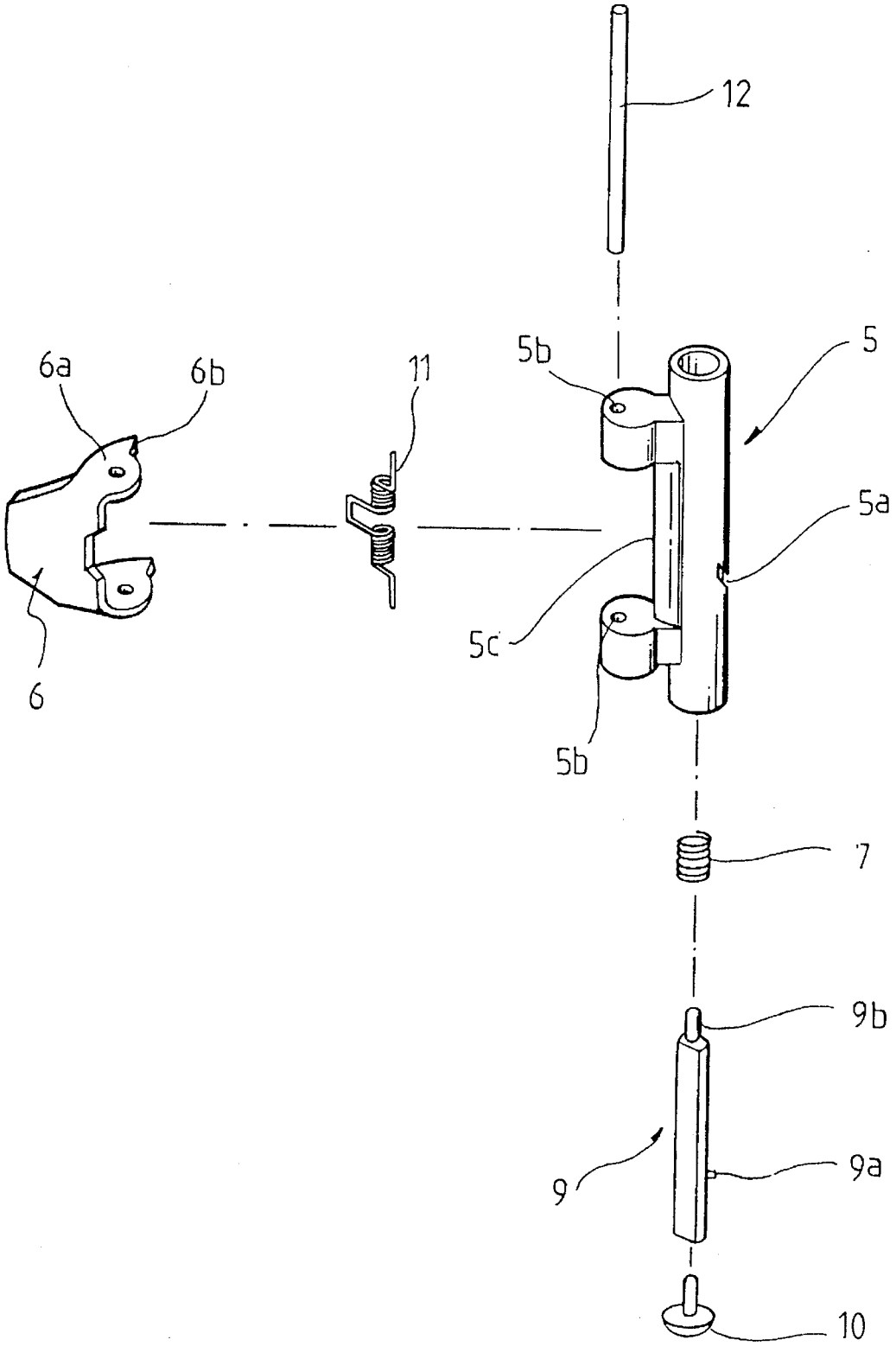
FIG. 3 is an exploded perspective view of a pawl assembly of the buckling means of the invention.
Figure 4A:
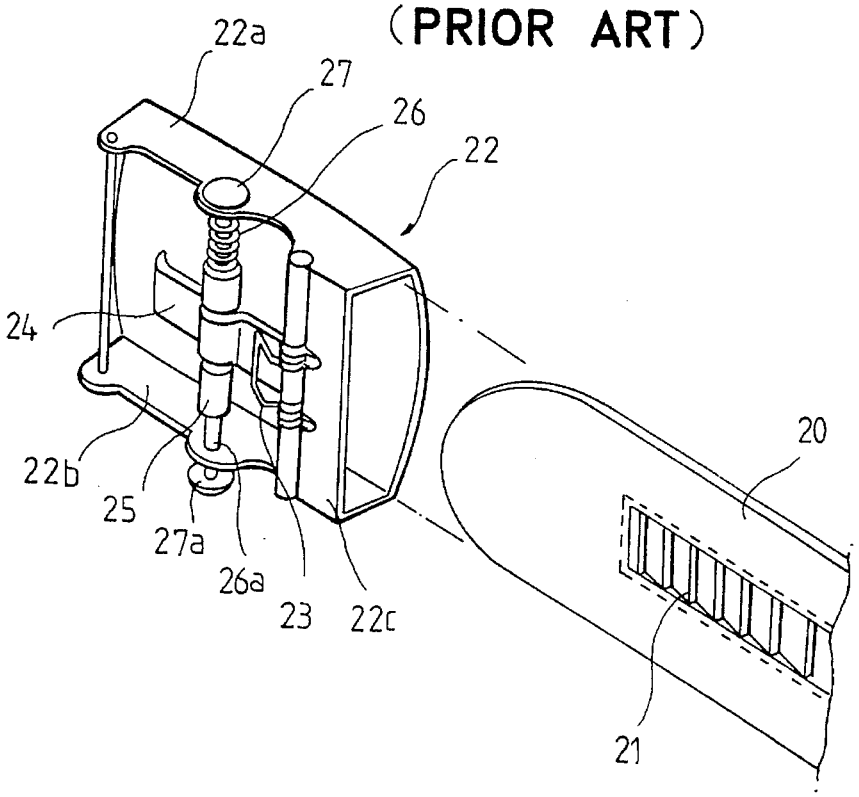
FIG. 4a (PRIOR ART)
FIGS. 4*a* and 4*b* are perspective view and sectional view of a belt having typical ratchet type buckling means respectively.
Figure 4B:
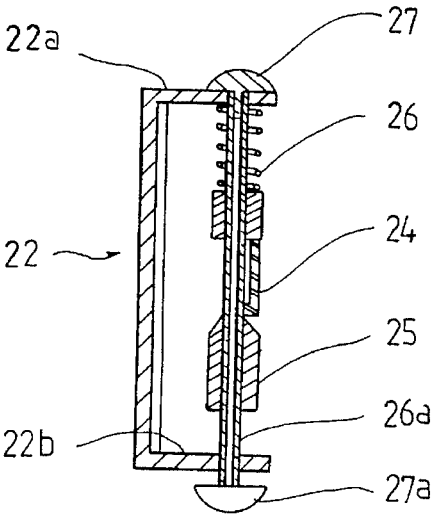
FIG. 4b (PRIOR ART)

With reference to FIGS. 1 to 3, there is shown a belt having ratchet type buckling means in accordance with an embodiment of the invention. As shown in the drawings, one end of the belt 3 is coupled to a coupling portion 2 of a buckle 1, while the back surface of the other end portion of the belt 3 is provided with a longitudinal ratchet part 4. The ratchet part 4 is a narrow strip having a plurality of teeth 4*a*.

The top and bottom walls of the buckle 1 are provided with a screw hole 1*a* and a rectangular hole 1*b* respectively. The buckle 1 also includes a pawl assembly vertically held between the top and bottom walls. The pawl assembly includes a rotatable cylinder 5 vertically placed between the holes 1*a* and 1*b*. The wall of the cylinder 5 has an inclined slit 5*a*. A pawl 6 for selectively engaging with the ratchet part 4 is pivoted to the cylinder 5. The top of the cylinder 5 is rotatably coupled to the screw hole 1*a* by means of a screw 8 so that the vertically placed cylinder 5 rotates about the hole 1*a*. A semi-circular push rod 9 is received in the cylinder 5 such that the bottom of the rod 9 projects out of the rectangular hole 1*b*. The push rod 9 has a radial projection 9*a* and a spring holder 9*b*. The radial projection 9*a* is formed on the round surface of the rod 9 and received in the inclined slit 5*a* of the cylinder 5, while the spring holder 9*b* extends from the top of the rod 9 and holds a biasing member or a compression coil spring 7 interposed between the screw hole 1*a* and the top of the rod 9. Due to the spring 7, the push rod 9 is biased downward. The bottom of the rod 9 projecting out of the rectangular hole 1*b* has a push knob 10.

In order to pivot the pawl 6 to the cylinder 5, top and bottom bosses 5*b* are formed on the outer surface of the cylinder 5 such that the bosses 5*b* are vertically spaced out at an interval. A thick stopper 5*c* is longitudinally formed on the outer surface of the cylinder 5 between the top and bottom bosses 5*b*. The pawl 6 has top and bottom bearing flanges 6*a* with pawl stoppers 6*b*. The pawl 6 is pivoted to the cylinder 5 by fitting a shaft 12 into the holes of the bearing flanges 6*a* and into the holes of the bosses 5*b*. In this case, a torsion spring 11 is fitted over the shaft 12 between the flanges 6*a* to bias the pawl 6. The pawl 6 is prevented from its sudden turning motion as the pawl stoppers 6*b* are stopped by the thick stopper 5*c*.

Fastening of the belt 3 is simply achieved by passing the other end portion of the belt 3 with the ratchet part 4 through the buckle 1 until the spring-biased pawl 6 engages with one of the teeth 4*a* of the ratchet part 4.

To unfasten the belt 3, the push knob 10 is pushed up to lift up the rod 9 while compressing the spring 7. In this case, the rod 9 does not rotate but is lifted up in the cylinder 5 as the semi-circular rod 9 is received in the rectangular hole 1*b*. The rotatable cylinder 5 thus rotates in the direction of arrow of FIG. 1 due to upward movement of the radial projection 9*a* received in the inclined slit 5*a* of the cylinder 5. Such rotation of the cylinder 5 turns the pawl 6 and thereby disengaging the pawl 6 from the ratchet part 4. In this state, the other end portion of the belt 3 can be pulled out of the buckle 1 and thereby unfastening the belt.

When removing the upward pushing force from the push knob 10, the rod 9 elastically moves down to its original position by the spring 7 and thereby rotating the cylinder 5 in reverse direction and returning the pawl 6 to its original position.

When the pawl 6 is suddenly applied with outside force after fastening the belt 3 worn around the waist, the pawl 6 is prevented from sudden turning motion relative to the cylinder 5 due to the pawl stoppers 6*b* stopped by the thick stopper 5*c* and thereby keeping the fastening state of the belt 3.

As described above, the present invention provides a belt with improved ratchet type buckling means. The buckle of the belt includes a vertically placed rotatable cylinder having an inclined slit. A spring-biased pawl for engaging and disengaging with or from a ratchet part of the belt is pivoted to the cylinder. A spring-biased rod is received in the cylinder such that the rod is vertically movable in the cylinder. A radial projection of the rod is received in the inclined slit of the cylinder so that the upward movement of the rod causes rotation of the cylinder along with the pawl and thereby disengaging the pawl from the ratchet part. The ratchet type buckling means of this invention is thus smoothly operated even by small force. Another advantage of the buckling means is resided in that the means has a simple construction and thereby reducing the buckle size and promoting user's convenience.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A belt with ratchet type buckling means comprising;

a buckle coupled to an end portion of the belt, the top and bottom walls of said buckle having a screw hole and a rectangular hole respectively;

a ratchet part provided on the back surface of the other end portion of the belt; and a rotatable cylinder vertically placed between the screw hole and the rectangular hole and rotatably coupled to the screw hole;

a pawl coupled to said cylinder and adapted for selectively engaging with said ratchet part;

a vertically movable push rod received in said cylinder such that the bottom of the push rod projects out of the rectangular hole, said push rod being biased by a spring member downward; and means for selectively rotating said cylinder along with the pawl to make the pawl disengage from the ratchet part when said push rod vertically moves up in the cylinder.

2. The belt according to claim 1, wherein said cylinder rotating means comprises:

a radial projection mounted on a side wall of said push rod; and an inclined slit formed on a side wall of said cylinder and movably receiving said radial projection.

3. A belt with ratchet type buckling means comprising;

a buckle coupled to an end portion of the belt, the top and bottom walls of the buckle having a screw hole and a rectangular hole respectively;

a ratchet part provided on the back surface of the other end portion of the belt; and a rotatable cylinder vertically placed between the screw hole and the rectangular hole and rotatably coupled to the screw hole;

a pawl coupled to said cylinder and adapted for selectively engaging with said ratchet part;

a vertically movable push rod received in said cylinder such that the bottom of the push rod projects out of the rectangular hole, said push rod being biased by a spring member downward; and means for selectively rotating said cylinder along with the pawl to make the pawl disengage from the ratchet part when said push rod vertically moves up in the cylinder; wherein said cylinder having:

top and bottom bosses adapted for mounting said pawl to the cylinder, said bosses being formed on the side wall of the cylinder and vertically spaced out at an interval; and a first stopper formed on the side wall of the cylinder between said bosses; said pawl having:

top and bottom bearing flanges for mounting the pawl to the top and bottom bosses of the cylinder with interposition of a torsion spring; and a second stopper formed in each of said bearing flanges, said second stopper being stopped by said first stopper and thereby preventing the pawl from sudden turning motion relative to the cylinder.

* * * * *